US005150337A

United States Patent [19]

Inbar

[11] Patent Number: 5,150,337

[45] Date of Patent: Sep. 22, 1992

[54] METHOD AND APPARATUS FOR MEASURING TIME ELAPSED BETWEEN EVENTS

[75] Inventor: Michael Inbar, Santa Barbara, Calif.

[73] Assignee: Applied Magnetics Corporation, Goleta, Calif.

[21] Appl. No.: 482,639

[22] Filed: Feb. 21, 1990

[51] Int. Cl.[5] ..... G04F 8/00

[52] U.S. Cl. ..... 368/118

[58] Field of Search ..... 368/115-120

[56] References Cited

U.S. PATENT DOCUMENTS

| | | | |
|---|---|---|---|
| 2,332,300 | 10/1943 | Cook | 368/115 |
| 2,546,814 | 3/1951 | Augustadt | 368/115 |
| 2,738,461 | 3/1956 | Burbeck et al. | 368/117 |
| 2,807,015 | 9/1957 | Shank | 368/117 |
| 2,829,342 | 4/1958 | Pfleger | 368/115 |
| 3,107,329 | 10/1963 | McSkimin | 368/117 |
| 3,390,348 | 6/1968 | Granqvost | 368/120 |
| 3,444,462 | 5/1969 | Tarczy-Hornoch | 368/117 |
| 3,518,539 | 6/1970 | Amano et al. | 324/77 |
| 3,889,189 | 6/1975 | Lode | 368/118 |
| 4,000,466 | 12/1976 | Scouten et al. | 368/117 |
| 4,303,983 | 12/1981 | Chaborski | 364/569 |
| 4,523,288 | 6/1985 | Hayashi | 364/569 |
| 4,523,289 | 6/1985 | Soma et al. | 364/569 |
| 4,637,733 | 1/1987 | Charles et al. | 368/120 |
| 4,678,345 | 7/1987 | Agoston | 368/119 |
| 4,704,036 | 11/1987 | Holte et al. | 368/120 |
| 4,769,798 | 9/1988 | Hayashi | 368/121 |
| 4,772,843 | 9/1988 | Asaka et al. | 320/1 |
| 4,827,317 | 5/1989 | Mizushima et al. | 368/120 |
| 5,027,298 | 6/1991 | Khazam | 368/120 |

*Primary Examiner*—Bernard Roskoski

*Attorney, Agent, or Firm*—Knobbe, Martens, Olson & Bear

[57] ABSTRACT

An apparatus and a method for determining the time difference between electrical events utilizes a sinusoidal signal as a reference from which to determine the elapsed time between events represented as electrical pulses. A sine wave and a cosine wave are multiplexed to produce the sinusoidal reference signal. When an event occurs, as indicated by an electrical pulse, the sine wave and the cosine wave are sampled to produce two digital values. A comparator determines which of the two digital values falls within a predetermined range, and transmits a select signal to multiplexer. The multiplexer selects the digital value which falls within the predetermined range. The selected digital value corresponds to an angle value which can be uniquely determined within one cycle of the sinusoidal reference signal. A cycle counter accounts for the number of full cycles which elapse until the next event is detected. The digital information for each event, including the angular position of each event within a cycle of the reference signal, and the number of cycles between events, is stored within a random access memory (RAM) and transmitted to a computer. The time difference between events is then advantageously calculated in real time within the computer using the known frequency of the effective reference signal.

12 Claims, 9 Drawing Sheets

METHOD AND APPARATUS FOR MEASURING TIME ELAPSED BETWEEN EVENTS

BACKGROUND OF THE INVENTION

This invention relates to a method and apparatus for measuring the time difference between two events, where each event is represented by an electrical pulse capable of triggering a digital circuit. In particular, this invention relates to time measurement systems accurate to within 10 picoseconds.

High resolution time measurement systems are required in a number of applications. For example, a time measurement system may be used to determine the bit error rate in an information transmission device. Because the phase of a digital signal can be determined by measuring the time difference between transitions (zero crossing points) of the digital signal, a statistical analysis can be performed upon the measured times between transitions of the digital signal to determine the quality of the information transmission. In information transmission devices which operate at very high frequencies, the time differences between transitions of the digital signal is sometimes on the order of 50 picoseconds. Thus, it is important to employ a time measurement system with a very high resolution.

A further example of an application for a high resolution time measurement device is in the field of pulse transmission and reflection. To determine the location of a breach in a fiber optic line, for example, a light pulse is propagated down the length of the optical fiber. The light pulse is then reflected at the point where the breach is located, and is detected at the light source location a finite time later. In order to determine the location of the breach in the fiber optic line, a very precise measurement must be taken of the time between the transmission of the light, and the detection of the reflected light. Therefore it is advantageous to employ a high resolution time measurement device in such applications.

Present high resolution time measurement systems generally employ linear ramp waveforms as a reference signal from which to measure the time difference between two electrical events. An example of such a linear ramp waveform 100 is illustrated in FIG. 1. The linear ramp waveform 100 has an amplitude function y(t) which varies over time as shown. It should be noted, however, that the conventional method for determining the time difference between two electrical events using a linear ramp waveform is subject to inherent limitations. Namely, the accuracy of the measurements to determine the time difference between two electrical events is dependent upon the linearity of the function y(t).

The frequency spectrum of the function y(t) is given by its Fourier transform $Y(\omega)$, where $$Y(\omega)=\omega_1+(\omega_2/3^2)+(\omega_3/5^2)+\ldots+\omega_n/(2n-1)^2 \quad (1)$$

where $\omega_i$ is the i-th harmonic of $\omega$. The frequency spectrum of y(t) is an infinite series, so that a perfectly linear waveform is obtained as n approaches infinity. Thus, in order for y(t) to be perfectly linear, the function y(t) must contain an infinite number of sine wave harmonic components. Each harmonic is an integer multiple of the frequency of the fundamental, so that the range of frequencies (or bandwidth) required to implement a perfectly linear signal y(t) is infinite. Since this is not practically possible, the actual implementation of the function y(t) will have some degree of distortion.

Note that the distortion introduced when using a linear ramp waveform as a reference signal is a limitation inherent to the method used in determining the time difference between events. Even if the components used within the time measurement system were ideal, it would be impossible to generate an infinite number of sine wave harmonics needed to produce a perfectly linear waveform. This inherent limitation is significant because, as technological advancements are made in component design, the distortion introduced within time measurement systems which use linear ramp waveforms will include an additional factor due to the infinite bandwidth requirement. Therefore, with advancements in component design, the distortion introduced within a time measurement system which employs a linear ramp waveform as a reference signal will not decrease as quickly as the distortion introduced within time measurement systems which employ reference waveforms that require a finite number of harmonics.

To reduce the distortion inherent within y(t) (to make y(t) more linear), additional harmonics must be added. Therefore, to obtain a high degree of accuracy in a method using a linear ramp as a reference waveform, it is necessary to use a high signal bandwidth. However, in systems which use a high bandwidth signal as a reference waveform, actual distortions in the reference signal are difficult to predict and verify.

A need then exists for a high resolution time measurement device which can operate at a relatively low frequency, and which has a low bandwidth. A further need exists for an apparatus and method for measuring time between events to a very high accuracy, which incorporates a reference signal that has properties which are easily predicted and verified.

SUMMARY OF THE INVENTION

An apparatus and method for determining the time elapsed between electrical events is disclosed which utilizes a sine wave as a reference signal from which to determine the elapsed time between events. The events are advantageously represented as electrical pulses such as may be used to clock a digital circuit.

In the preferred embodiment, a sine wave and a cosine wave are sampled upon each detection of an electrical event to produce two digital values. The two digital values are multiplexed in response to a select signal from a magnitude comparator to produce an effective digital sinusoidal reference signal which eliminates the low resolution portions of each sampled wave in order to provide the highest possible resolution. The magnitude comparator generates a signal which causes the digital value corresponding to the magnitude of the sampled sine wave to be selected if the magnitude of the sampled sine wave is within a predetermined range. The magnitude comparator generates a signal which causes the digital value corresponding to the magnitude of the sampled cosine wave to be selected if the magnitude of the sampled sine wave is outside of the predetermined range.

The selected digital value is input to a programmable read only memory (PROM) which has stored arcsine values. Each selected digital value corresponds to a digital angle value stored within the PROM, the digital angle value is uniquely determined within one quarter cycle of the sinusoidal effective reference signal. A quadrant detector determines which quadrant the effective reference signal is in, and thus allows for a determination of an angular value, corresponding to the time that an event occurs, within one full cycle of the effective reference signal. A cycle counter accounts for the number of full cycles which elapse until the next event is detected.

The digital information for successive events, including the angular position of each event within a cycle of the reference signal, and the number of cycles between events, is stored within adjacent memory locations within a random access memory (RAM) and transmitted to a computer.

The time difference between events is then advantageously calculated in real time within the computer using the known frequency of the effective reference signal.

DETAILED DESCRIPTION OF THE PREFERRED EMBODIMENT

Figure 1:
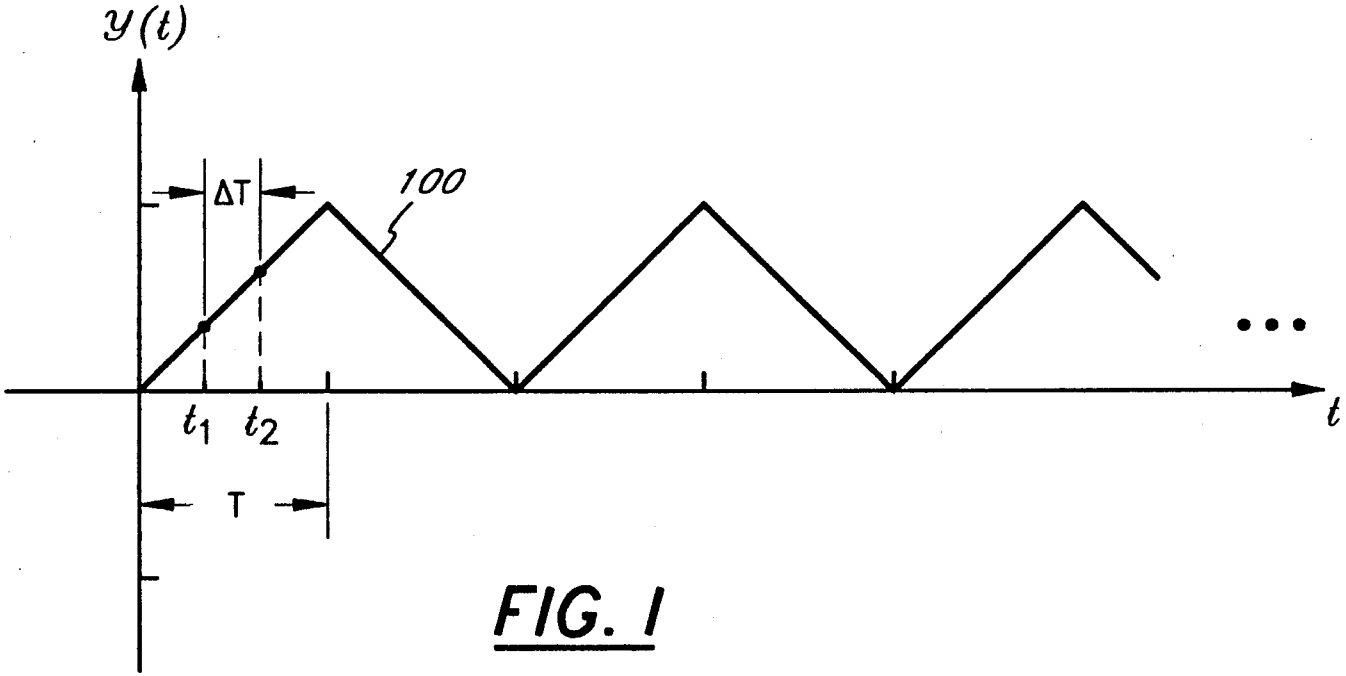
FIG. 1 depicts a linear ramp waveform such as may be used in accordance with conventional time measurement systems.

The problems inherent in previous time measurement systems which incorporate linear ramp waveforms as reference signals can be eliminated if the reference signal used is a sine wave instead of a linear ramp waveform. Sine waves are easily produced, and are substantially distortion free in high quality generators. Since only one harmonic is required to produce a sine wave, the bandwidth of the sine wave signal is effectively zero because only one frequency is being generated. Of course, in practical applications the bandwidth of a particular sine wave signal may be on the order of a few hertz due to imperfections within a typical sine wave generator. Thus, a sine wave provides a low distortion, low bandwidth signal as a reference signal for a time measurement system.

Note that a time measurement system which employs a sine wave as a reference signal does not have the same inherent limitations as does a time measurement system which employs a linear ramp waveform as a reference signal. Namely, in order to produce a first order sine wave, only one harmonic is needed. Thus, as advancements are made in component design technologies, it is conceivable that the distortion incorporated within a time measurement system which employs a sine reference wave will become negligible.

The present invention utilizes a sine wave as a reference signal. Advantageously, the amplitude of the reference sine wave is sampled at a time $t_1$, and sampled again at a later time $t_2$. Sampling of the reference sine wave is advantageously accomplished by converting the analog reference sine wave into digital values using an analog-to-digital convertor. Each digital value corresponds to a voltage amplitude level of the analog reference sine wave. The digital values corresponding to the amplitude of the reference sine wave at $t_1$ and $t_2$ respectively can then be compared to determine a corresponding time difference between the events at $t_1$ and $t_2$.

For any time measurement system it is desireable to increase the system resolution so that a more accurate differentiation can be made between events in time. The resolution of a time measurement system which incorporates a sine wave as a reference signal depends upon the frequency of the reference sine wave, and the number of samples taken per cycle of the reference sine wave. In a preferred embodiment of the present invention, the analog-to-digital convertor advantageously converts a 2 V peak-to-peak sine wave into 256 discrete voltage levels over the range of $-1$ V to $+1$ V in each cycle. Each digital increment therefore corresponds to a voltage difference of 2 volts divided by 256 samples (2/256), or 0.0078125 volts per sample. Of course, the voltage amplitude of the sine wave employed in accordance with the present invention need not be 2 V peak-to-peak, and the number of samples taken in each cycle need not be 256. In practice, any reasonable values which are suitable for a given environment may be used.

The preferred frequency for the reference sine wave employed in accordance with the present invention is 32.8 MHz, however, the frequency of the reference sine wave need not be 32.8 MHz. In practice, a frequency on the order of 50 MHz can typically be used, although certain component imperfections, which shall be discussed below, prevent effective utilization of frequencies over 100 MHz.

In the preferred embodiment of the present invention, the system resolution is further increased by utilizing only certain portions of the generated reference sine wave. To illustrate the advantages of using only certain portions of the reference sine wave, a numerical analysis of the system resolution over portions of the reference sine wave follows.

In order to perform a numerical analysis, it is necessary to define the time measurement system resolution as a function of the time measurement system parameters. It is apparent that a time measurement system which can perform measurements accurate to a very small time increment has a higher resolution than a time measurement system which is capable of performing measurements only accurate to a larger time increment. Therefore, the resolution for a given time measurement system must be inversely proportional to the measurable time increment between events, $\Delta T$. The resolution of the time measurement system can then be defined as a time measurement system constant, K, divided by the change in time, $\Delta T$, or $K/\Delta T$. Since the time measurement system described herein determines the time difference between events as a function of voltage amplitude, the time measurement system constant, K, is advantageously defined as the incremental change in voltage $\Delta V$ per each change in time. Thus the time measurement system resolution can be defined as $\Delta V/\Delta T$ for the time measurement system described herein. Note again that the incremental change in voltage, $\Delta V$, is a constant and defines the sampling increment (0.0078125 volts in the preferred embodiment). It can be seen that the quantity $\Delta V/\Delta T$ also defines the slope of the reference voltage waveform.

If the resolution of the time measurement system is defined as the change in voltage divided by the change in time ($\Delta V/\Delta T$), then it can be seen that the resolution of the time measurement system is lowest at the maxima and minima points (where the slope is lowest) of the reference sine wave. The following examples help to display that the lowest resolution occurs at the maxima and minima points of the reference sine wave.

Assume, as set forth above, that the sampling increment is 0.0078125 volts. Assume also that the reference sine wave frequency is chosen to be 50 megahertz. If the reference sine wave is sampled into 256 increments, then the output digital value will contain eight binary bits. If the sign bit (the bit which indicates if the voltage is positive or negative, and which is typically in the most significant bit position) is ignored then the magnitude of the reference sine wave is obtained. The magnitude of the reference sine wave thus corresponds to the last seven bits of the digital value output by the analog-to-digital convertor. The maximum point of the reference sine wave thus corresponds to a digital state of 128 (decimal). The 128th voltage level state corresponds to:

$$128\times 0.0078125\ V=1.0\ volt=\sin(90°).$$

The 127th state corresponds to:

$$127\times 0.0078125\ V=0.9922\ volts=\sin(82.83°).$$

Thus the angular change, $\Delta\theta$, between the 128th and the 127th states is calculated as:

$$\Delta\theta=90°-82.83°=7.17°.$$

An angular change of 7.17° corresponds to a change in time, $\Delta T$, of:

$$[7.17°/(360°\times 50\times 10^6\ Hz)]=398\ picoseconds$$

for a 50 megahertz sine wave. That is, the time difference between sampling intervals is 398 picoseconds. Therefore, at the maxima region of the reference sine wave, there is an uncertainty of 398 picoseconds concerning the exact location in time at which an event may have occurred.

As set forth above, the resolution of the time measurement system is defined as $\Delta V/\Delta T$. Thus, between the 127th and 128th states, the resolution of the time measurement system is calculated to be:

$$\Delta V/\Delta T=0.0078125/398\times 10^{-12}=19.6\times 10^6.$$

Assuming that the reference sine wave is symmetrical in the positive and negative cycles, a resolution analysis performed on the maximum point of the reference sine wave applies equally to the minimum point of the reference sine wave. Thus the resolution at the minimum point of the reference sine wave is also $19.6\times 10^6$.

Similarly, the resolution can be calculated at the region of maximum slope of the reference sine wave. The 0th state corresponds to sin(0°), while the 1st state corresponds to:

$$0.0078125\ \text{volts}=\sin(0.448°).$$

Thus the angular change, $\Delta\theta$, between the 0th and 1st states is calculated as:

$$\Delta\theta=0.448°-0°=0.448°.$$

An angular change of 0.448° corresponds to a change in time of:

$$\Delta T=[0.448°/(360°\times 50\times 10^6\ Hz)]=24.9\ picoseconds$$

for a 50 megahertz sine wave. Therefore, at the zero-crossing region of the reference sine wave, there is an uncertainty of 24.9 picoseconds concerning the exact location in time at which an event may have occurred.

In this case, the resolution between the 1st and 0th states is calculated to be:

$$\Delta V/\Delta T=0.0078125/24.9\times 10^{-12}=314\times 10^6.$$

It can be seen that the highest resolution ($314\times 10^6$) occurs at the zero crossing point of the reference sine wave (where the slope is the highest), while the lowest resolution ($19.6\times 10^6$) occurs at the maxima and minima regions of the reference sine wave (where the slope is the lowest).

The resolution of the time measurement system at the maxima and minima points of the reference sine wave is approximately 1/16th of the time measurement system resolution at the zero crossing point of the reference sine wave. Therefore it is advantageous to operate the time measurement system on portions of the reference sine wave which are near to the zero-crossing point in order to obtain a higher time measurement system resolution. There exists a further advantage of operating on the portion of the reference sine wave near the zero-crossing point. Namely, the portion of the reference sine wave close to the zero-crossing point is nearly linear. Thus, the portion of the reference sine wave close to the zero-crossing point has easily predicted and verifiable properties.

In the preferred embodiment, the apparatus of the present invention advantageously provides two reference sine wave signals, $y_1(t)$ and $y_2(t)$. Advantageously, the signals $y_1(t)$ and $y_2(t)$ have the same amplitude (for example, 2 V peak-to-peak), the same frequency (for example, 32.8 MHz in the preferred embodiment), and are 90° out of phase with respect to each other.

In order to optimize resolution, the apparatus of the present invention advantageously utilizes only the regions of the reference sine wave which have an amplitude between 0.707 volts and −0.707 volts. While the amplitude of $y_1(t)$ is between 0.707 V and −0.707 V, $y_1(t)$ is used as the reference sine wave, and while the amplitude of $y_2(t)$ is between 0.707 V and −0.707 V, $y_2(t)$ is used as the reference sine wave. Note that, since $y_2(t)$ is 90° out of phase with $y_1(t)$, each signal will be provided as the reference sine wave of the time measurement system for exactly one half of each cycle, with $y_1(t)$ "on" while $y_2(t)$ is "off", and $y_2(t)$ "on" while $y_1(t)$ is "off."

It would be possible for one skilled in the art to implement the apparatus of the present invention in a manner such that the "on" time for the first sine wave, $y_1(t)$, is greater than (or less than) the "on" time for the second sine wave, $y_2(t)$, so that there is not a 50/50 active distribution of the two reference signals $y_1(t)$ and $y_2(t)$. It should be noted, however, that a 50/50 distribution of the "on"/"off" time for both of the reference signals provides the optimum system resolution, and that any deviation from this 50/50 distribution will result in a sacrifice of system resolution as well as the system linearity.

Figures 3A, 3B, 3C:
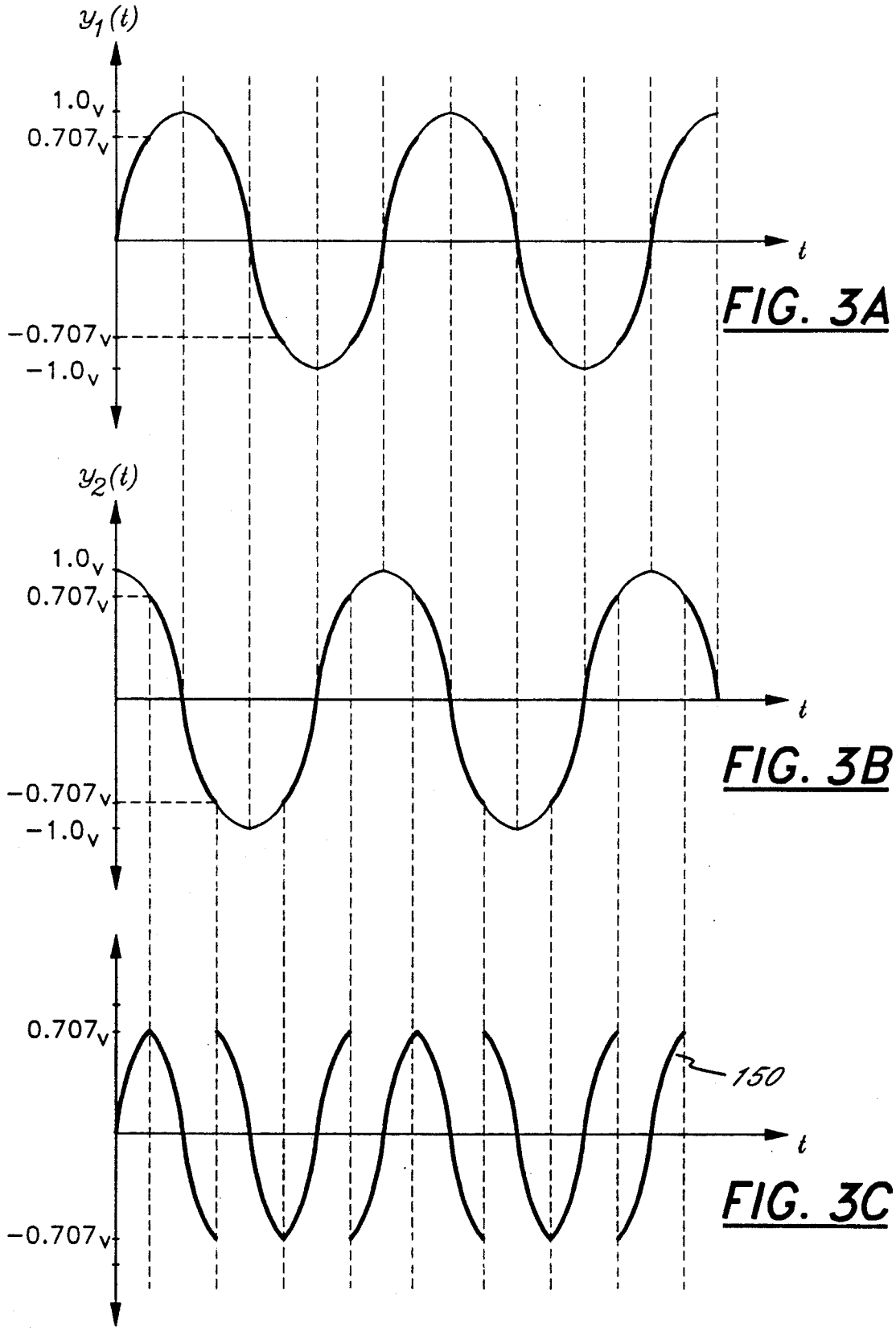
FIGS. 3A–3C depict the sinusoidal waveforms such as are advantageously used in accordance with the present invention.

FIGS. 3A and 3B illustrate the relationship between the sampled portions of both $y_1(t)$ and $y_2(t)$. FIG. 3A depicts the entire cycle of $y_1(t)$, with the portions of the sine wave which are used as the reference signal darkened (i.e., where $0.707\ V > y_1(t) > -0.707\ V$). FIG. 3B depicts the entire cycle of $y_2(t)$, with the portions of the sine wave which are used as the reference signal darkened (i.e., where $0.707\ V > y_2(t) > -0.707\ V$). By alternating between two separate sine waves which are 90° out of phase with respect to each other, an effective reference signal 150 is provided which incorporates certain amplitude and frequency characteristics of a sine wave, while also providing a time measurement system resolution which is substantially higher than the resolution which could be obtained from a single sine wave.

FIG. 3C depicts the effective reference signal 150 produced by multiplexing the two sine wave signals, $y_1(t)$ and $y_2(t)$, each half cycle. Note that the maximum magnitude of the effective reference signal 150 is 0.707 volts. Because the effective reference signal 150 is produced by a simple multiplexing of two, single harmonic, sine waves, the bandwidth of the effective reference signal 150 remains substantially the same. Namely, the bandwidth of the effective reference signal 150 equals the bandwidth of $y_1(t)$ (or alternatively $y_2(t)$).

Recall that the two sine waves $y_1(t)$ and $y_2(t)$ are multiplexed in order to provide an effective reference signal 150 which does not contain the low resolution portions of either $y_1(t)$ or $y_2(t)$. An analysis of the effective reference signal 150 follows below which shows that the resolution characteristics of the effective reference signal 150 is significantly improved over the resolution characteristics of an ordinary sine wave such as $y_1(t)$ or $y_2(t)$.

Assuming again a digital voltage increment of 0.0078125 volts, and an effective reference signal frequency of 50 megahertz, the resolution of the effective reference signal 150 can be obtained. Since the effective reference signal 150 is essentially the same at the zero crossing region as the corresponding signals $y_1(t)$ and $y_2(t)$, it can be inferred that the resolution remains the same at the zero crossing portion of the effective reference signal 150 as at the zero crossing portions of $y_1(t)$ and $y_2(t)$, namely $314 \times 10^6$. The resolution is expected to be lowest at the maximum and minimum portions of the effective reference signal 150, since at these points the change in voltage with respect to time is lowest. The maximum of the effective reference signal 150 occurs at a voltage of 0.707 volts. A voltage of 0.707 volts corresponds to:

$$0.707/0.0078125 = 90.5 \text{ states}$$

The digital voltage level states must, however, be integers. Thus, the resolution is determined from the differential angle between the 91st and 90th states. The angle corresponding to the 91st state is calculated as:

$$Arcsine(91 \times 0.0078125) = 45.31°.$$

The angle corresponding to the 90th state is calculated as:

$$Arcsin(90 \times 0.0078125) = 44.68°.$$

Therefore, the differential angle, $\Delta\theta$ is calculated as:

$$\Delta\theta = 45.31° - 44.68° = 0.63°.$$

The change in time, $\Delta T$, over the angle $\Delta\theta$ for a frequency of 50 megahertz can then be calculated as:

$$\Delta T = [0.63°/(360° \times 50 \times 10^6\ Hz)] = 35.2\ picoseconds.$$

Thus, the resolution between the 90th and 91st states is calculated as:

$$\Delta V/\Delta T = 0.0078125/35.2 \times 10^{-12} = 221 \times 10^6.$$

It can be seen that the lowest resolution of the effective reference signal 150 ($221 \times 10^6$) is approximately 11 times greater than the lowest resolution of a normal sine wave ($19.6 \times 10^6$) of the same frequency. Thus, the resolution of the effective reference signal 150 is significantly improved over the resolution of either the signal $y_1(t)$ or the signal $y_2(t)$.

Of course it is possible to increase the resolution of the system by other methods. For example, the frequency of the reference sine wave could be increased to improve the system resolution. However, as previously stated, component imperfections prevent accurate time measurements for frequencies above 100 MHz. Alternatively, other portions of the two reference curves could be used to generate an effective reference signal, but this would result in a reduction of resolution from the implementation of the effective reference signal 150 described above. This is because, if half of a sine wave is to be used in order to generate the effective reference signal 150, optimum resolution of the sine wave occurs between 0.707 volts and −0.707 volts. Finally, it is conceivable that more than two reference sine waves could be multiplexed to generate an effective reference signal. Multiplexing more than two sine waves to generate an effective reference signal could result in a higher resolution system, however the increase in system resolution would not be significant, while the increase in circuit complexity within the system would be considerable.

As mentioned above, it is possible to implement the apparatus of the present invention so that the effective reference signal 150 is not symmetrical (does not have a 50/50 "on"/"off" cycle). In this case it is desireable to define a certain range of tolerance wherein the apparatus of the present invention is advantageously operated. For example, an acceptable resolution tolerance can reasonably be defined to be $196 \times 10^6$, or ten times the lowest resolution of the reference sine wave. Under such circumstances, the "on"/"off" distribution would be approximately 57/43. That is, the reference sine wave $y_1(t)$ would be "on" for 57% of the cycle of the effective reference signal 150, and "off" for 43% of the cycle of the effective reference signal 150. Alternatively, the reference sine wave $y_2(t)$ would be "on" for 57% of the cycle of the effective reference signal 150, and "off" for 43% of the cycle of the effective reference signal 150.

Figure 2:
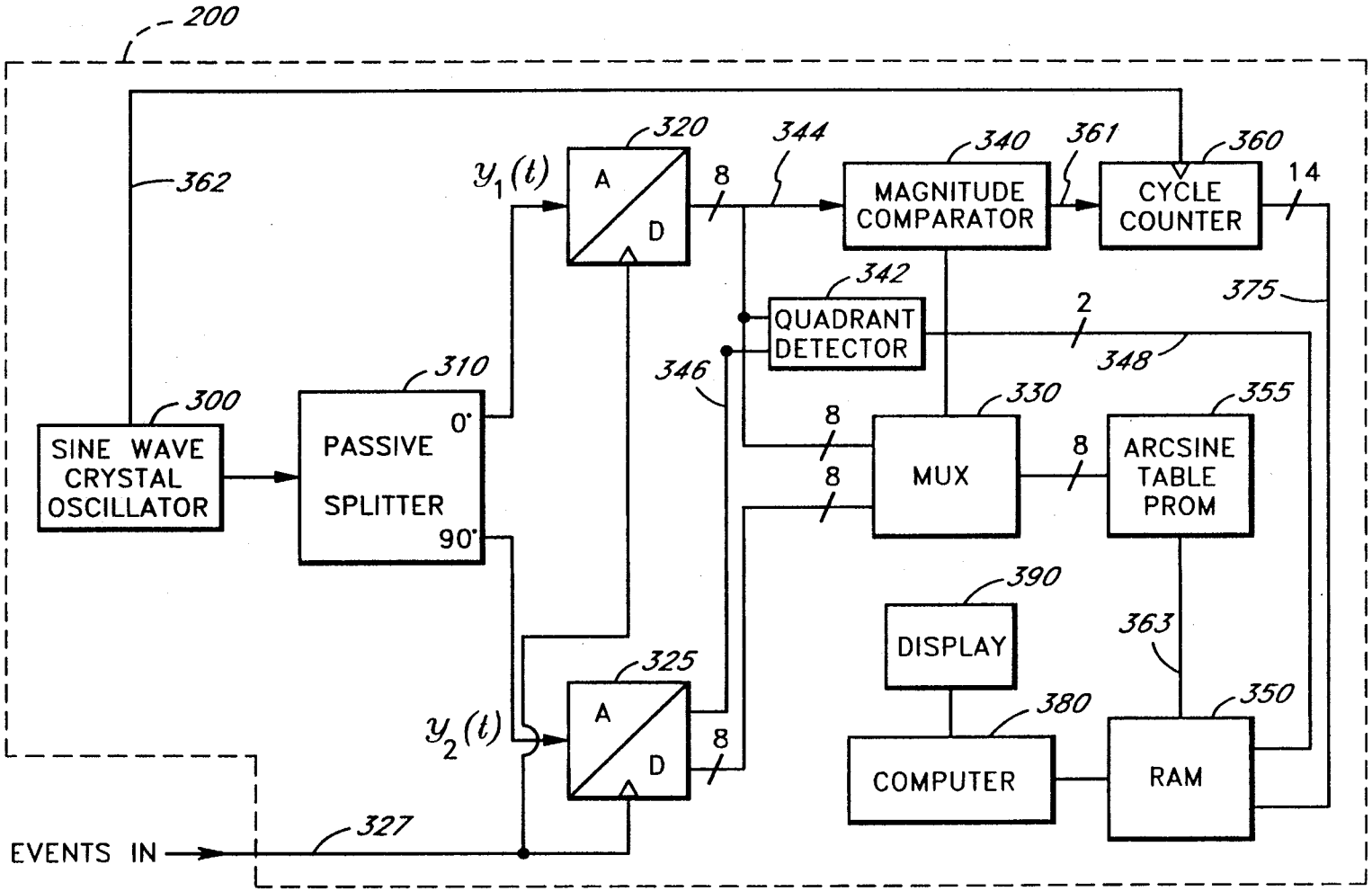
FIG. 2 depicts an exemplary block diagram of the apparatus employed in accordance with the present invention.

FIG. 2 illustrates an exemplary block diagram of a time measurement system 200 employed in accordance with the present invention. A sine wave crystal oscillator 300 generates an analog sine wave which is transmitted to a conventional passive splitter circuit 310. The passive splitter circuit 310 generates two corresponding sinusoidal signals $y_1(t)$ and $y_2(t)$, which are 90° out of phase with respect to each other. The output signal, $y_1(t)$, of the passive splitter circuit 310 has the same amplitude, the same frequency, and is in phase with, the sine wave output from the crystal oscillator 300. The output signal $y_2(t)$ is 90° out of phase with the sine wave output from the crystal oscillator 300 to the passive splitter 310. Thus, $y_1(t)$ corresponds to a sine wave, while $y_2(t)$ corresponds to a cosine wave of the same magnitude and frequency as $y_1(t)$.

The signal $y_1(t)$ is input into an 8-bit analog-to-digital converter 320. The 8-bit analog-to-digital converter 320 converts the amplitude of the signal $y_1(t)$ into one of 256 digital voltage levels or states. The 8-bit value output from the analog-to-digital convertor 320 is referred to hereinafter as $Z_1$. Similarly, the second output signal from the passive splitter $y_2(t)$ is input into an 8-bit analog-to-digital converter 325. The analog-to-digital converter 325 also converts the amplitude of the signal $y_2(t)$ into one of 256 digital voltage states. The 8-bit digital value output from the analog-to-digital convertor 325 is referred to hereinafter as $Z_2$. The analog-to-digital-convertors 320, 325 are advantageously implemented as fast flash A/D convertors. The 8-bit binary values, $Z_1$ and $Z_2$, which are output from the analog-to-digital convertors 320, 325 advantageously consists of 7 magnitude bits corresponding to 128 digital values from 0 V to 1 V, and a sign bit which indicates whether the voltage is positive or negative. The sign bit is advantageously the most significant bit of both $Z_1$ and $Z_2$. For example, an input voltage amplitude of +1 volt corresponds to a digital state of 127 (decimal), in addition to a most significant sign bit of "1" indicating a positive voltage, resulting in a digital state of 255 (decimal). Likewise an input voltage of −1 volt would produce a digital value of 127 (decimal), in addition to a most significant sign bit of "0" indicating a negative voltage, at the output of the appropriate analog-to-digital convertor 320, 325.

Both of the 8-bit- analog-to-digital converters 320, 325 receive a clock input from a line 327. The clock input signal from the line 327 is advantageously a digital pulse representing an event in real time. Each event must be represented as an electrical pulse such as can be used to clock the analog-to-digital convertors 320, 325. When an electric pulse on the line 327 exceeds a predetermined threshold level (indicating the detection of an event), the digital voltage state, $Z_1$, corresponding to the amplitude of the signal $y_1(t)$, is output from the analog-to-digital convertor 320 to a multiplexer 330. Simultaneously, the digital voltage state, $Z_2$, corresponding to the amplitude of the signal $y_2(t)$, is output from the analog-to-digital convertor 325 to the multiplexer 330.

The digital voltage state $Z_1$ is also output to a magnitude comparator 340. The magnitude comparator 340 determines whether or not the voltage level corresponding to the amplitude of the signal $y_1(t)$ is within a predetermined range. In accordance with the present invention, this predetermined voltage range is advantageously from −0.707 volts to 0.707 volts.

Figure 4A:
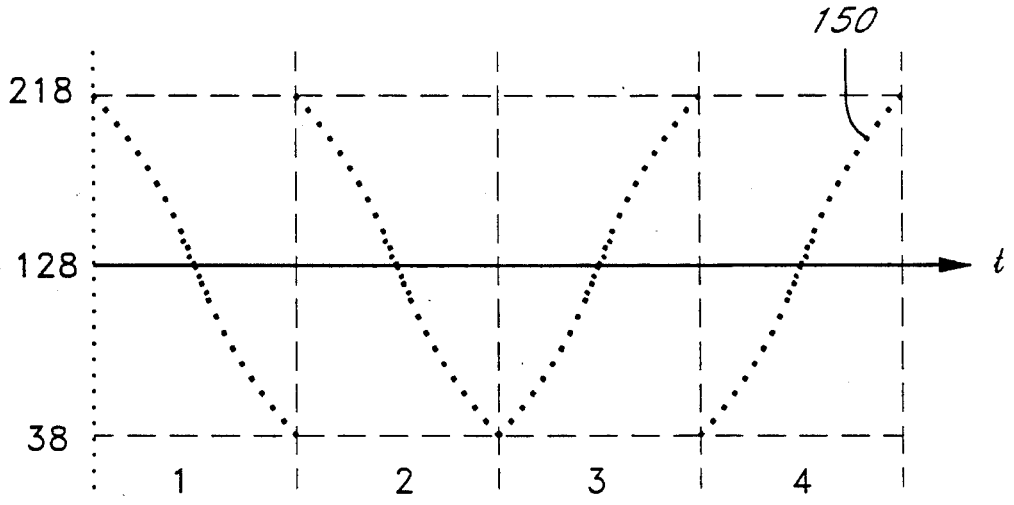
FIGS. 4A and 4B illustrate the digitally sampled waveforms used in accordance with the present invention.

The magnitude comparator 340 transmits a select signal to the multiplexer 330. If the digital voltage state $Z_1$ corresponds to an amplitude of $y_1(t)$ which is greater than −0.707 volts, and is less than 0.707 volts, then the magnitude comparator 340 transmits a select signal which causes the multiplexer 330 to output the digital value $Z_1$. Otherwise, the magnitude comparator 340 transmits a select signal which causes the multiplexer 330 to output the digital value $Z_2$. In this way, the digital sampling of $y_1(t)$ and $y_2(t)$ can be combined to form a digitally sampled effective reference signal 150 as depicted in FIG. 4A.

Figure 4B:
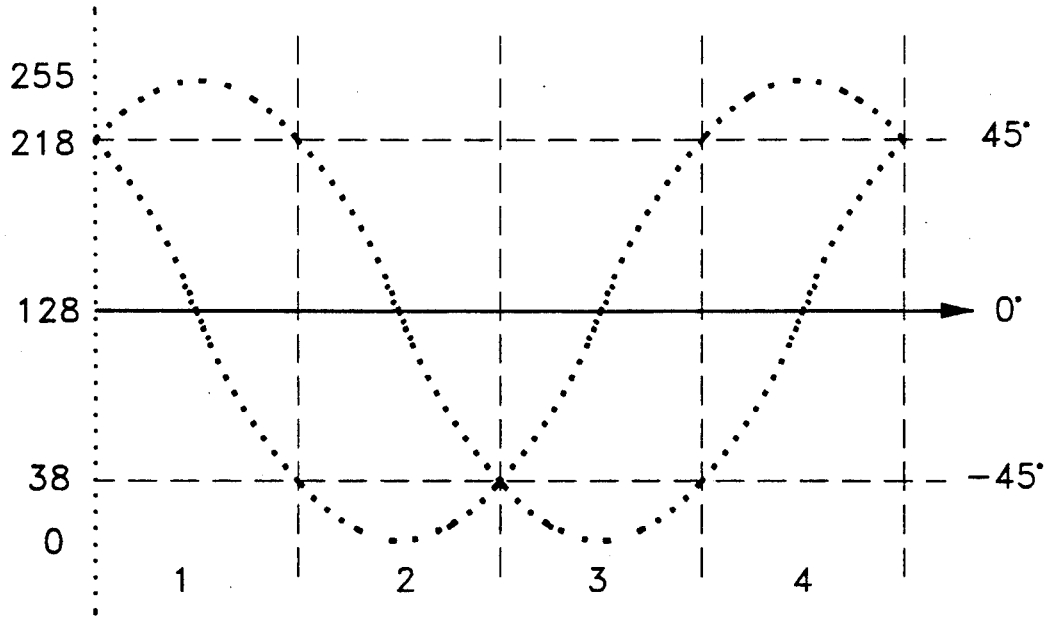

FIG. 4B depicts the relationship between the two waveforms $y_1(t)$ and $y_2(t)$ after sampling. The digital values corresponding to the amplitude of each waveform range from 0 to 255 (decimal) with a digital value of 128 (a sign bit of "1" and seven binary magnitude bits of "0000000") corresponding to an amplitude of zero. Note that the true complement must be taken of the last seven bits of the digital values corresponding to the negative portion of both $y_1(t)$ and $y_2(t)$. The true complement is taken in order to obtain the appropriate magnitude for each negative digital value. For example, as shown in FIG. 4B, a voltage of −0.707 volts corresponds to an uncomplemented digital value of 38. The binary sign bit for −0.707 volts is "0" and the seven uncomplemented binary magnitude bits for −0.707 volts are "0100110," resulting in a binary value of "00100110." A voltage of +0.707 volts corresponds to a digital value of 218. The binary sign bit for +0.707 volts is "1" and the seven binary magnitude bits for +0.707 volts are "1011010," resulting in a binary value of "11011010." Note that although the magnitudes of the two voltages are equal (i.e., 0.707 volts), the seven binary magnitude bits are not the same. In order to obtain equivalent binary magnitude bits for both the positive and negative voltage values, the true complement (also known as two's complement) is taken of the seven magnitude bits which correspond to the negative voltage. For example, the true complement of "0100110" is "1011010," so that the seven magnitude bits are the same for voltages with equivalent magnitudes. The true complement of the negative voltage values is advantageously taken at the output of the analog to digital convertors 320, 325.

Figure 5:
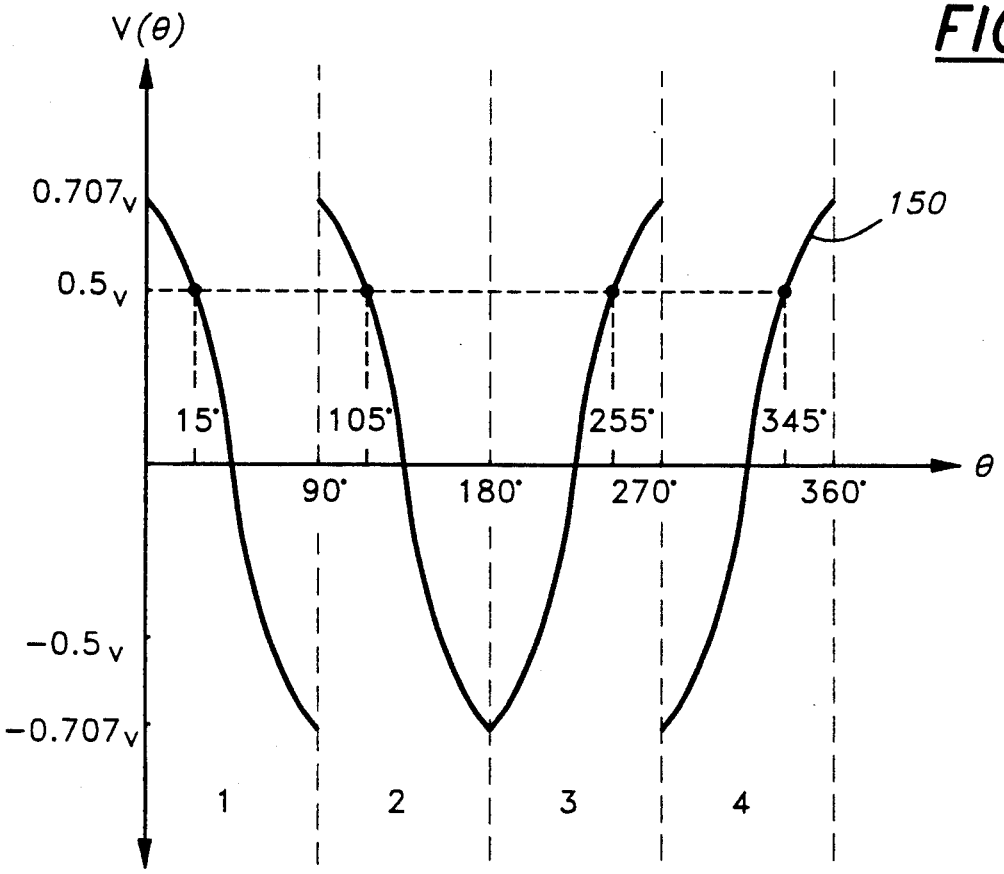
FIG. 5 depicts one cycle of the effective reference signal used in accordance with the present invention.

FIG. 5 depicts one complete cycle of the effective reference signal 150. Note that the effective reference signal 150 in FIG. 5 is plotted against the angle $\theta$, rather than time, so that the waveform depicted is frequency independent. It can be seen from FIG. 5 that there are four angle values which correspond to the same voltage amplitude in each cycle of the effective reference signal 150. For example, as shown in FIG. 5, a voltage amplitude of 0.5 volts corresponds to an angle measure of 15°, 105°, 255°, and 345°. In order to determine which angle value is correct for a given voltage, a quadrant detector 342 outputs a two bit value that indicates which quadrant of the effective reference signal 150 is currently being sampled. The two-bit quadrant value is determined in the quadrant detector 342 in response to the 8-bit magnitude value, $Z_1$, output from the analog-to-digital convertor 320 along a bus 344, and the most significant (sign) bit of $Z_2$ output from the analog-to-digital convertor 325 along a line 346.

The quadrant detector 342 includes conventional circuitry to determine the quadrant of the effective reference signal 150. The quadrant of the effective reference signal 150 can be determined from the sampled values, $Z_1$ and $Z_2$, of the waveforms $y_1(t)$ and $y_2(t)$. The following table outlines the four possible states which determine the quadrant of the effective reference signal 150.

| $Z_1$ | Sign Bit of $Z_2$ | Two-Bit Quadrant Value |
|---|---|---|
| $Z_1>218$ | X | 00 |
| $38<Z_1<218$ | 0 | 01 |
| $Z_1<38$ | X | 10 |
| $38<Z_1<218$ | 1 | 11 |

An "X" indicates that it is unnecessary to know the sign bit of $Z_2$ to determine the quadrant of the effective reference signal 150. Note that for any quadrant, each voltage level corresponds to only one angle, so that a unique angle can be determined for a given voltage if the quadrant is also known. The two-bit quadrant value is then transmitted across a line 348 to a random access memory (RAM) 350.

The multiplexer 330 selects which of the two digital states, $Z_1$ or $Z_2$, to transmit to a programmable read only memory (PROM) 355. Each digital state of $Z_1$ and $Z_2$ serves as an address to a memory location within the PROM 355. The PROM 355 contains an arcsine table which includes a degree measure corresponding to each of the possible digital states of $Z_1$ and $Z_2$. For example, if $y_1(t)$ has an amplitude of 0.5 volts (sin(30°)), then the corresponding digital state, $Z_1$, has a magnitude value of 64 (decimal), with a sign bit of "1" (thus having an overall decimal value of 192). The digital value 192 is the address of a memory location within the PROM 355. The memory location with an address of 192 within the PROM 355 contains an eight-bit digital value corresponding to the degree measure (30°) of the original signal, $y_1(t)$.

The arcsine table within the PROM 355 is advantageously implemented so that one voltage level corresponds to the address of one and only one angle value regardless of the quadrant of the effective reference signal 150. That is, due to the symmetrical nature of the quadrants of the effective reference signal 150 for the particular case where the "on"/"off" time is 50/50, only a 90° angle range, corresponding to one quadrant of the effective reference signal 150, needs to be accounted for within the arcsine table PROM 355. Advantageously, the range of voltage levels which are used to address memory locations within the PROM 355 correspond to stored angle values as indicated by the graph shown in FIG. 6. For instance, the voltage level 192 (corresponding to a voltage of +0.5 volts) is the address of the angle value +30°. Although the range of values contained within the arcsine table prom 355 is from −45° to +45° in the preferred embodiment, any 90° span of values could be used (for example 0° to 90°) with minor alterations to the time measurement system 200.

In the case that the "on"/"off" time is not evenly distributed, the arcsine table PROM 355 could be implemented so that the entire range of angle values from 0° to 360° are stored in memory locations within the PROM 355. To address a particular memory location in this case, the digital voltage level as well as the two-bit quadrant value would be used so that a unique angle within one cycle of the effective reference signal 150 could be determined.

As set forth above, in the preferred embodiment of the present invention, the 8-bit analog-to-digital convertors 320, 325 convert the sinusoidal input ($y_1(t)$ or $y_2(t)$) into 256 discrete voltage levels over the range of −1 V to +1 V in each cycle. So that each digital increment corresponds to a voltage difference of (2/256) V or 0.0078125 volts. It should be noted, however, that neither of the digital states, $Z_1$ or $Z_2$, transmitted to the PROM 355 will ever correspond to a signal magnitude of more than 0.707 volts. Therefore, not all of the 256 digital voltage states need correspond to a memory location address within the PROM 355. The total number of memory locations containing arcsine values in the PROM 355 can be calculated as:

$$0.707\times(256\ states)=181\ states.$$

Thus, there are 181 arcsine values (corresponding to a voltage range from −0.707 volts to 0.707 volts) stored within the PROM 355.

The magnitude comparator 340 also transmits a latch signal to a cycle counter 360 along a line 361. The cycle counter 360 keeps track of how many periods (full cycles) have elapsed between clock pulses to the analog-to-digital convertors 320, 325. The output of the oscillator 300 is transmitted to the cycle counter 360 over a line 362, so that the cycle counter 360 can account for each cycle. The cycle counter 360 advantageously accounts for up to 16,384 ($2^{14}$) cycles as a 14-bit digital value, although it is possible to implement the present invention so that the cycle counter 360 can account for more, or less, than 16,384 cycles. When the latch signal from the magnitude comparator 340 is transmitted to the cycle counter 360 along the line 361, the count registered within the cycle counter 360 is latched and transmitted to the RAM 350. The cycle counter 360 is then reset to zero, and again begins accounting for full cycles of the output sine wave of the oscillator 300.

When the cycle counter 360 is latched and reset there exists a certain time period where the cycle counter 360 is unstable. It is possible that, during this unstable period, a second event may trigger the cycle counter 360 and thereby cause the cycle counter 360 to output an indeterminate state. In order to insure that an error is not produced during the unstable period of the cycle counter 360, two synchronized counters (not shown) are advantageously implemented within the cycle counter 360. The two counters within the cycle counter 360 are synchronized so that in the event that one counter is unstable, the other counter is stable. The cycle counter 360 further includes conventional switching circuitry which transmits the latch signal from the magnitude comparator 340 to the second counter on alternating clock signals along the line 327. That is, each counter within the cycle counter 360 is used at every other event detection so that stability is assured.

When a first event is detected, a latch signal is sent from the magnitude comparator 340 to the cycle counter 360 along the line 361. The switching circuitry within the cycle counter 360 then transmits the latch signal to the first synchronous counter within the cycle counter 360. The switching circuitry can be implemented, for example, as a T flip-flop. The count value registered in the first synchronous counter within the cycle counter 360 is then latched and transmitted to the RAM 350. Simultaneously, a signal is transmitted to the second synchronous counter which causes the second synchronous counter to initiate counting from zero. The first synchronous counter is then reset to zero. When a second event is detected, a latch signal is again sent from the magnitude comparator 340 to the cycle counter 360 along a line 361. The switching circuitry within the cycle counter 360 then transmits the latch signal to the second synchronous counter within the cycle counter 360. The count value registered in the second synchronous counter within the cycle counter 360 is then latched and transmitted to the RAM 350. Simultaneously, a signal is transmitted to the first synchronous counter which causes the first synchronous counter to initiate counting from zero. The second synchronous counter is then reset to zero. This process repeats so that alternating counters are used on alternating events. In this manner problems resulting from counter instability can be avoided.

When a digital value (either $Z_1$ or $Z_2$) is output from the multiplexer 330 to the PROM 355, the PROM 355 outputs the eight-bit digital angle value stored within the memory location addressed by the input digital value. The eight-bit angle value from the PROM 355 is then transmitted along a line 365 to the RAM 350. The eight-bit digital angle value is then stored in a memory location within the RAM 350. The 14-bit digital output of the cycle counter 360 is also transmitted to the RAM 350 along a data line 375. The 14-bit value is stored in the same memory location as its corresponding eight-bit digital angle value. Finally, the two-bit quadrant value transmitted from the magnitude comparator 340 is also stored in the same memory location as its corresponding arcsine digital value. Thus, in each memory location within the RAM 350, there are 24 bits: 14 bits from the cycle counter 360, 8 bits from the Arcsine table PROM 355, and 2 quadrant bits from the magnitude comparator 340. Each detected event therefore corresponds to a memory location within the RAM 350. The 24-bit words corresponding to successive detected events are stored in successive adjacent memory locations within the RAM 350.

The data stored within each memory location of the RAM 350 is transmitted to a computer 380. In the computer 380, the 24-bit data words contained in successive memory locations are processed to determine the time difference between their corresponding detected electrical events. A detailed description of the processing procedure is discussed below. The computer 380 could also be implemented as a microprocessor or a similar device with processing capabilities. The results are then output to a display unit 390. The display unit 390 may comprise, for example, a computer monitor or a tape output.

In order to determine the time difference between two electrical events in accordance with the present invention, a first digital pulse representing an event occurring at time $t_1$ is transmitted along the line 327 to both the analog-to-digital convertor 320, and the analog-to-digital convertor 325. Both analog-to-digital convertors 320, 325 have an associated conversion delay time of $Y+\sigma$, where Y is a constant conversion time, and $\sigma$ is a variable aperture jitter which varies randomly each time the analog-to-digital convertor 320, 325 is clocked.

Each time an event represented by a digital pulse on the line 327 is detected at the input to the analog-to-digital convertors 320, 325, the respective digital state ($Z_1$ or $Z_2$) is output by both analog-to-digital convertors 320, 325. The digital value, $Z_1$, output by the analog-to-digital convertor 320 corresponds to the amplitude value $y_1(t_1)$, while the digital value, $Z_2$, output by the analog-to-digital convertor 325 corresponds to the amplitude value $y_2(t_1)$.

The digital value $Z_1$ is transmitted to the magnitude comparator 340. The magnitude comparator 340 determines if $Z_1$ corresponds to an analog voltage, $y_1(t_1)$, between $-0.707$ volts and $+0.707$ volts. A voltage magnitude of 0.707 volts corresponds to a digital value of:

$$(0.707)/(0.0078125)=90.5 \text{ states.}$$

Thus, if the seven magnitude bits of $Z_1$ are greater than 90, this indicates that the magnitude comparator 340 will transmit a select signal to the multiplexer 330 which causes $Z_2$ to be selected. Otherwise the magnitude comparator 340 transmits a signal to the multiplexer 330 which causes $Z_1$ to be selected.

The digital states, $Z_1$ and $Z_2$, are both transmitted to the multiplexer 330 which, in response to a select signal from the magnitude comparator 340, selects the appropriate value (either $Z_1$ or $Z_2$) to transmit to the PROM 355. The transmitted one of $Z_1$ or $Z_2$ addresses the memory location of the PROM 355 which contains an angle value that is the Arcsine of $y_1(t_1)$ (or the Arcsine of $y_2(t_2)$ if $Z_2$ is selected). For example, if the selected digital value corresponds to a voltage of 0.344 volts, then the angle value stored within the PROM 355 is:

$$\text{Arcsine}(0.344)=20.5°.$$

Figure 6:
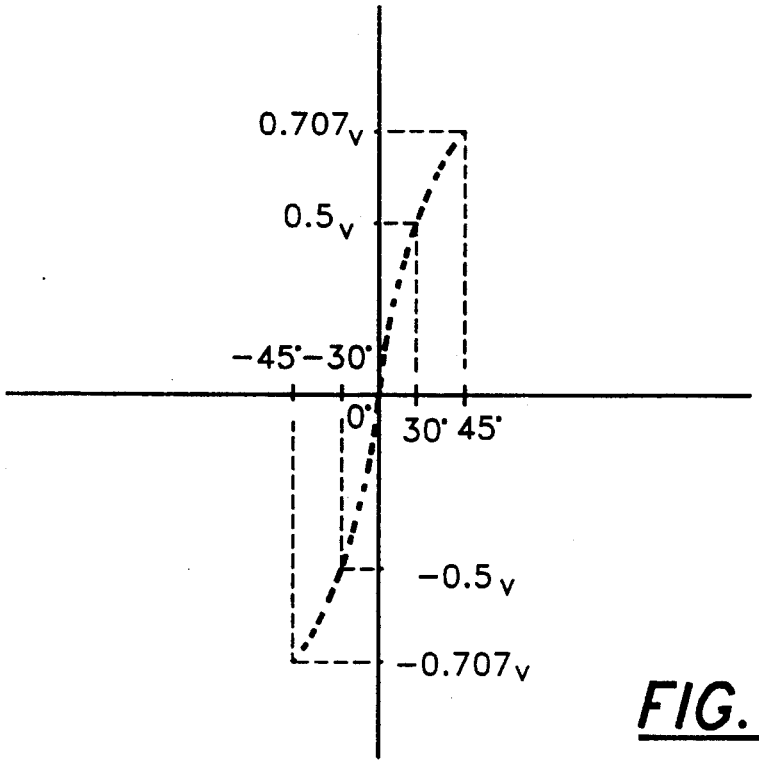
FIG. 6 depicts a range of arcsine values corresponding to the amplitude of the effective reference signal as employed in the present invention.

The PROM 355 then transmits an 8-bit digital value, representing 20.5°, to the RAM 350. Note that the value output from the PROM 355 is an angle, and is therefore frequency independent. In other words, the value output by the PROM 355 will be the same for identical amplitudes, regardless of the frequency of the reference signal. The angle values output by the PROM 355 advantageously range from $-45°$ to $+45°$, as depicted in FIG. 6, because each quadrant is a quarter cycle and has a 90° range which can be arbitrarily defined.

It can be seen that the digital angle value output by the PROM 355 does not indicate which quadrant of the effective reference signal 150 that the event occurs. Thus, there remain four possible times within the cycle that the event could have occurred. Because there remain four possible cases (one for each quadrant) in which the event could occur, additional data must be stored within the RAM 350 in order to determine the correct time, $t_1$. The quadrant detector 342 provides the RAM 350 with a two-bit binary value that indicates which quadrant of the effective reference signal 150 that the event at $t_1$ occurs in. Thus, the angular position corresponding to the occurrence of an event at time $t_1$, can be uniquely determined within one cycle of the effective reference signal 150.

The process described above is repeated when a second digital pulse, representing an event occurring at a time $t_2$, is transmitted along the line 327. Hence, a second digital angle value, as well as a second two-bit quadrant value, is output to a second memory location within the RAM 350 which corresponds to $t_2$. The second memory location in the RAM 350 is adjacent to the memory location corresponding to $t_1$.

After the first pulse representing the event at $t_1$ clocks the analog-to-digital convertors 320, 325, a latch signal is transmitted to the cycle counter 360 via the magnitude comparator 340. The cycle counter 360 is incremented each time a full cycle of the effective reference signal 150 has elapsed, so that the total number of complete elapsed cycles are accounted for. When the second event at $t_2$ clocks the analog-to-digital convertors 320, 325, which in turn cause the magnitude comparator 340 to transmit a latch signal to the cycle counter 360, the 14-bit digital count recorded by the cycle counter 360 is transmitted to the RAM 350. The 14-bit digital count value latched in response to the second event at $t_2$ is stored in the memory location corresponding to $t_2$, along with the 8-bit digital angle value and the 2-bit quadrant value corresponding to $t_2$. The cycle counter 360 is then reset once again to zero, and proceeds to account for each full cycle between $t_2$ and the time, $t_3$, when the next event occurs. Note that, if the first counter within the cycle counter 360 is used to account for all the full cycles between $t_1$ and $t_2$, then the second counter within the cycle counter 360 will be used to account for all the full cycles between $t_2$ and $t_3$.

The method continues on in this manner using alternating counters within the cycle counter 360 so that the time difference can be determined between any number of events from $t_0$ to $t_1$, from $t_1$ to $t_2$, from $t_2$ to $t_3$, etc. until $t_n$. Notice that the process of determining the time differences between events advantageously occurs in real time. That is, that as the events occur, a running record is output to the computer 380 which computes the time differences immediately. Of course, the time measurement system 200 may be implemented to store the values in the RAM 350 until a later time, so that the process need not occur in real time.

In order to determine the time difference between two events, the data contained within two successive memory locations within the RAM 350 are output to the computer 380. FIGS. 7A-7D depict the four different cases of event detection. Each separate case illustrated in FIGS. 7A-7D requires a different calculation formula to properly determine the time difference between two electrical events. The calculation formulas are advantageously contained within the computer 380. Also contained within the computer 380 is the frequency value, in hertz, of the sine wave generated by the sine wave crystal oscillator 300 so that a time difference can be determined from the angular values stored within the RAM 350.

Figure 7A:
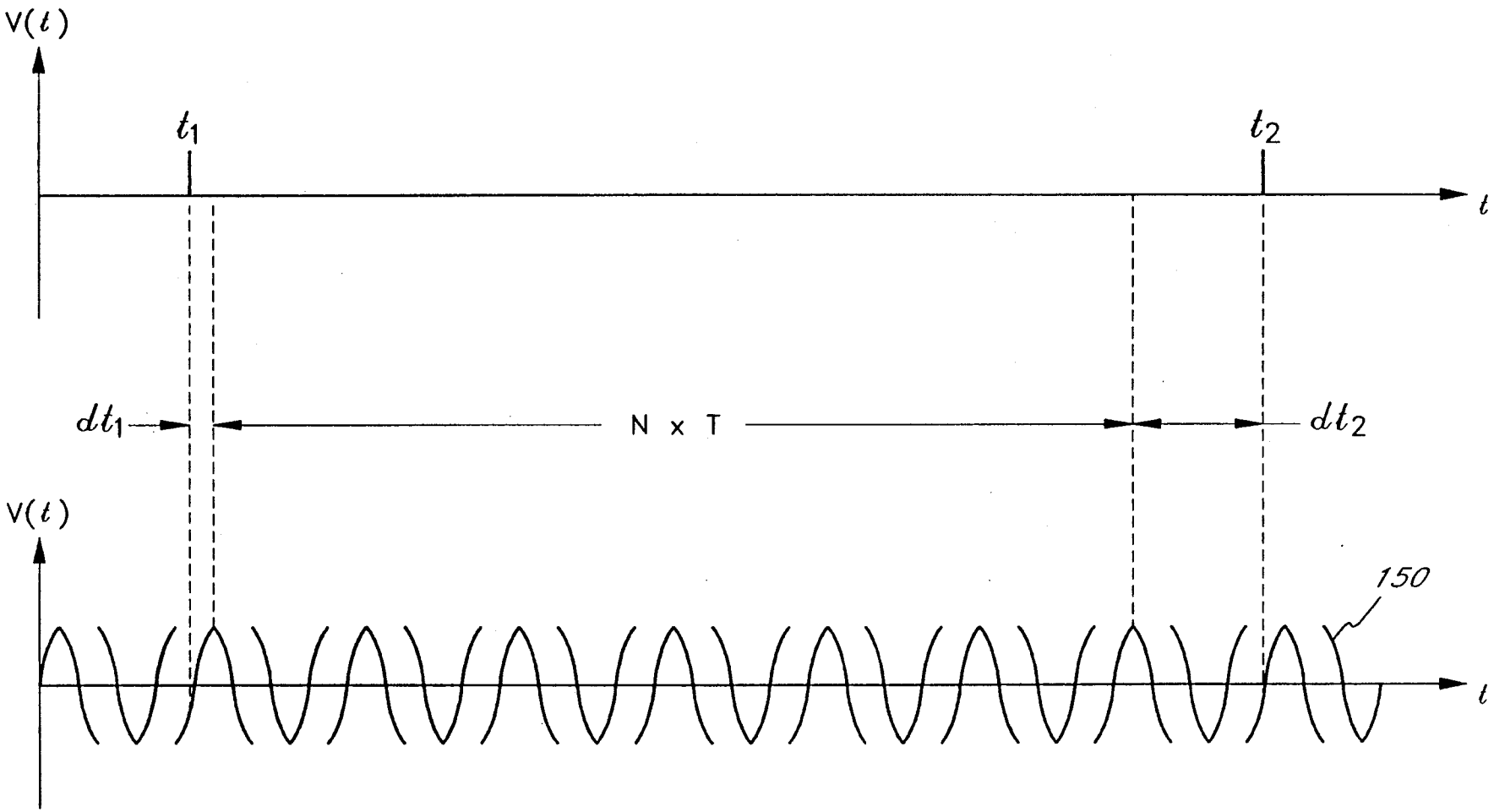
FIGS. 7A–7D illustrate the four different cases of event detection which may occur in accordance with the method of the present invention.

FIG. 7A depicts the first case of event detection where both $t_1$ and $t_2$ are detected within a positive sloping portion of the effective reference signal 150. Note that the first two quadrants of the effective reference signal 150 are both negative sloping while the third and fourth quadrants of the effective reference signal 150 are positive sloping. The total time difference between $t_1$ and $t_2$ can be calculated as the time difference $dt_1$, plus the time difference $dt_2$, plus the time difference accounted for by the number of full cycles between $t_1$ and $t_2$, or:

$$\Delta T = dt_1 + dt_2 + NxT \quad (2)$$

where N is the decimal value of the 14-bit cycle counter value stored within the memory location corresponding to the second of the two compared event times (in this case $t_2$), and T is the cycle period (1/F) as determined using the frequency value of the effective reference signal 150 stored within the computer 380.

The time difference $dt_1$ can be calculated as:

$$dt_1 = [(5 - Q1) \times 90° - (\Phi 1 + 45°)] \times [1/(F \times 360°)]. \quad (3)$$

Where Q1 is the value (1, 2, 3, or 4 as shown in parenthesis in the table above) of the 2-bit quadrant value contained within the memory location corresponding to $t_1$, $\Phi 1$ is the value in degrees of the 8-bit angle value contained within the memory location corresponding to $t_1$, and F is the frequency of the effective reference signal 150 in hertz. Note that, as stated above, the frequency value of the effective reference signal 150 is contained within the computer 380 so that the frequency value can be easily changed to accommodate different oscillator circuits such as the crystal sine wave oscillator 300.

The angle value, $\Phi 1$, represents the angle value as addressed by the selected digital voltage level ($Z_1$ or $Z_2$), and has a range from −45° to +45° as shown in FIG. 6. Due to the symmetrical nature of the effective reference signal 150 when the "on"/"off" time is evenly distributed (50/50), a unique angle value within one cycle of the effective reference signal 150 can be calculated within Equation (3) as long as the quadrant value, Q1, is known.

The time difference $dt_2$ can be calculated as:

$$dt_2 = [(Q2 \times 90°) + (\Phi 2 - 45°)] \times [1/(F \times 360°)]. \quad (4)$$

Again, Q2 and $\Phi 2$ are the quadrant value, and the angle value respectively, as stored in the memory location corresponding to $t_2$.

The angle value, $\Phi 2$, represents the angle value as addressed by the selected digital voltage level ($Z_1$ or $Z_2$), and has a range from −45° to +45° as shown in FIG. 6. Due to the symmetrical nature of the effective reference signal 150 when the "on"/"off" time is evenly distributed, a unique angle value within one cycle of the effective reference signal 150 can be calculated within Equation (4) as long as the quadrant value, Q2, is known.

Finally, The time accounted for by the number of elapsed full cycles, N, can be calculated as:

$$(N \times 360°) \times [1/(F \times 360°)] \quad (5)$$

Thus the total time difference between two events at $t_1$ and $t_2$ can be calculated as:

$$\Delta T = [(5 - Q1) \times 90° - (\Phi 1 + 45°) + (Q2 \times 90°) + (\Phi 2 - 45°) + (N \times 360°)] \times [1/(F \times 360°)] \quad (6)$$

for the case where both $t_1$ and $t_2$ are in quadrants 3 or 4 of the effective reference signal 150. The computer 380 employs Equation (6) when the two-bit quadrant value contained within the memory location corresponding to $t_1$ is 3 or 4 (i.e., "10," or "11" in binary), and the two-bit quadrant value contained within the memory location corresponding to $t_2$ is 3 or 4.

Figure 7B:
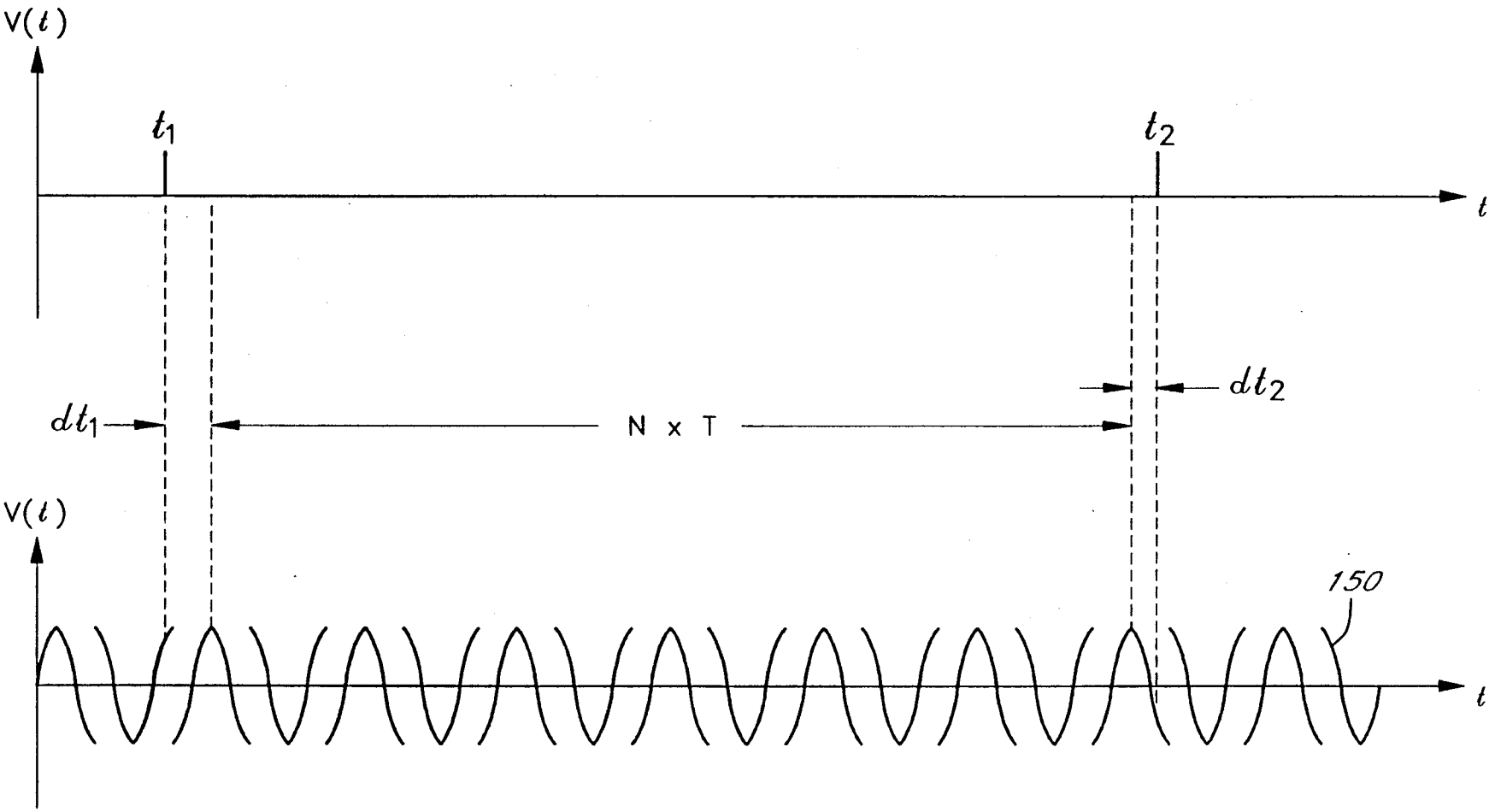

FIG. 7B depicts the second case where $t_1$ lies either in quadrant 3 or 4, and $t_2$ lies either in quadrant 1 or 2. The time difference $dt_1$, and the time corresponding to the number of full cycles of the effective reference signal 150, can be calculated as described above in case 1. The time difference $dt_2$ can be calculated as:

$$dt_2 = [(Q2 \times 90°) - (\Phi 2 + 45°)] \times [1/(F \times 360°)]. \quad (7)$$

Thus, the total time difference between $t_1$ and $t_2$ can be calculated as:

$$\Delta T = [(5 - Q1) \times 90° - (\Phi 1 + 45°) + (Q2 \times 90°) - (\Phi 2 + 45°) + (N \times 360°)] \times [1/(F \times 360°)] \quad (8)$$

for the case where $t_1$ lies in either quadrant 3 or 4, and $t_2$ lies in either quadrant 1 or 2. The computer 380 employs Equation (8) when the two-bit quadrant value contained within the memory location corresponding to $t_1$ is 3 or 4 ("10", or "11" in binary), and the two-bit quadrant value contained within the memory location corresponding to $t_2$ is 1 or 2 ("00," or "01" in binary).

Figure 7C:
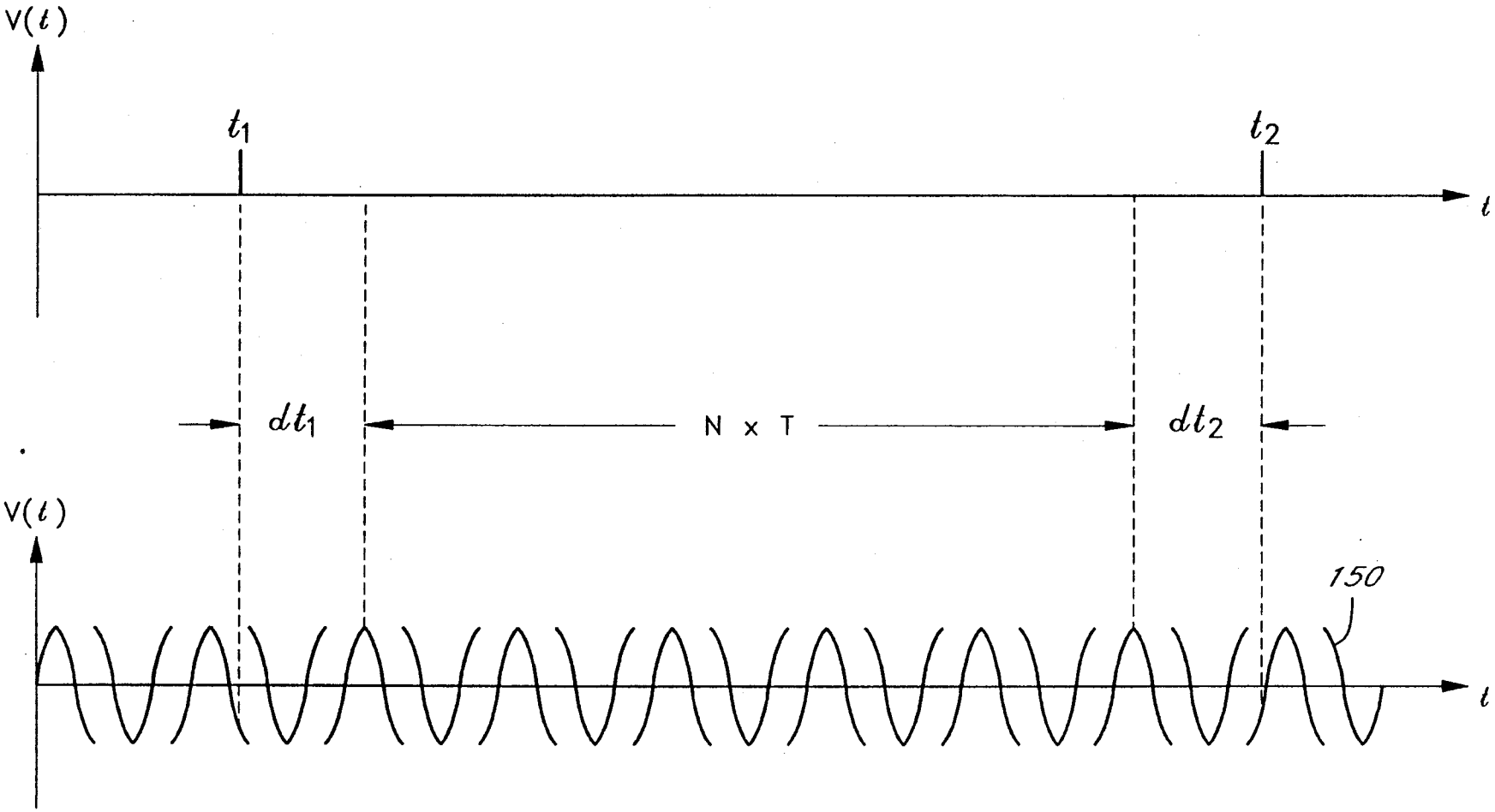

FIG. 7C depicts the third case where $t_1$ lies either in quadrant 1 or 2, and $t_2$ lies either in quadrant 3 or 4. The time difference $dt_2$, and the time corresponding to the number of full cycles of the effective reference signal 150, can be calculated as described above in case 1. The time difference $dt_1$ can be calculated as:

$$dt_1=[(5-Q1)\times 90^\circ+(\Phi 1-45^\circ)]\times[1/(F\times 360^\circ)]. \quad (9)$$

Thus, the total time difference between $t_1$ and $t_2$ can be calculated as:

$$\Delta T=[(5-Q1)\times 90^\circ+(\Phi 1-45^\circ)+(Q2\times 90^\circ)+(\Phi 2-45^\circ)+(N\times 360^\circ)]\times[1/(F\times 360^\circ)] \quad (10)$$

for the case where $t_1$ lies in either quadrant 1 or 2, and $t_2$ lies in either quadrant 3 or 4. The computer 380 employs Equation (10) when the two-bit quadrant value contained within the memory location corresponding to $t_1$ is 1 or 2, and the two-bit quadrant value contained within the memory location corresponding to $t_2$ is 3 or 4.

Figure 7D:
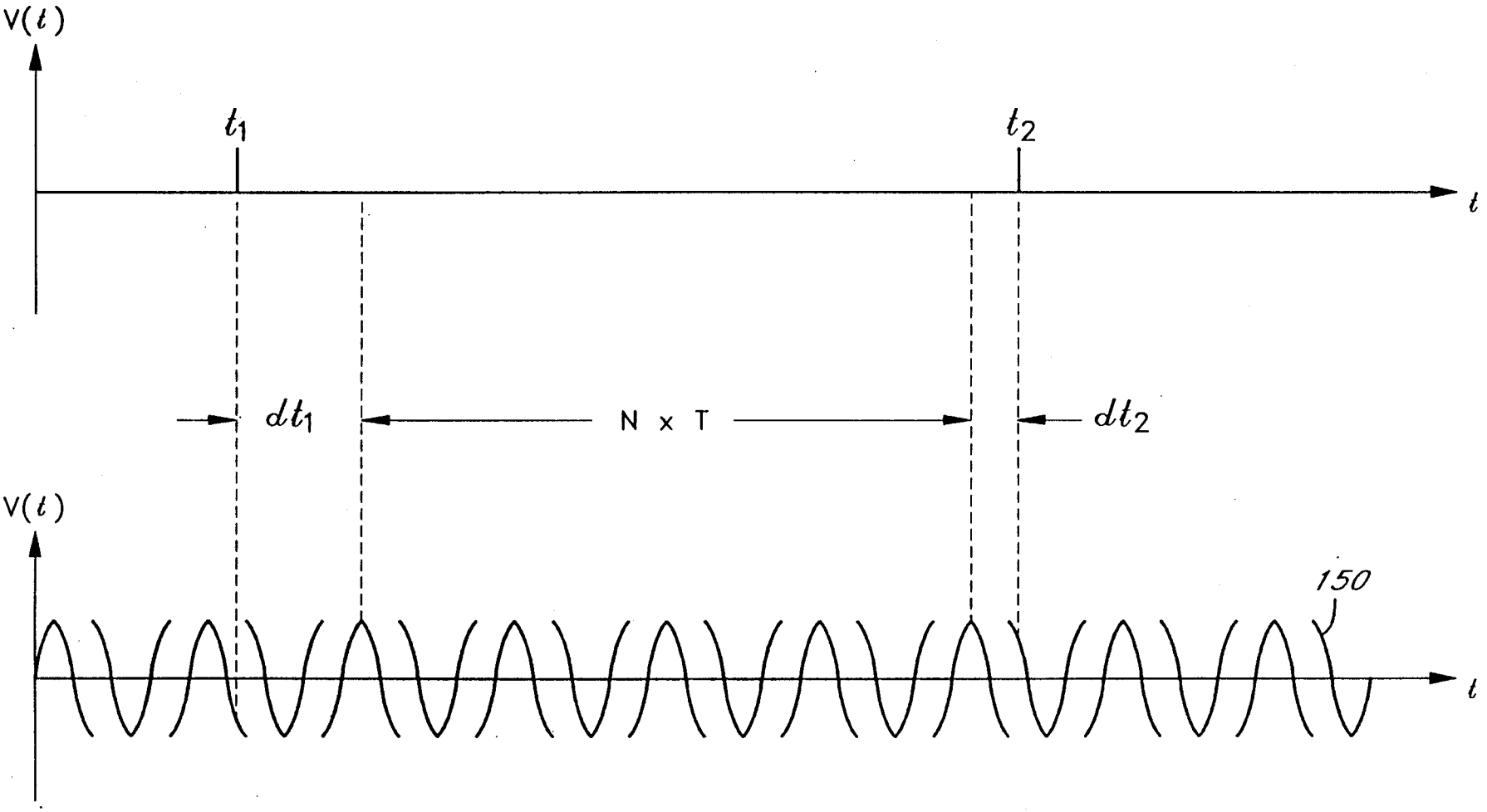

FIG. 7D depicts the fourth case where both $t_1$ and $t_2$ lie either in quadrant or quadrant 2. The time difference $dt_1$, and the time corresponding to the number of full cycles of the effective reference signal 150, can be calculated as described above in the third case. The time difference $dt_2$ can be calculated as stated above in the second case to be:

$$dt_2=[(Q2\times 90^\circ)-(\Phi 2+45^\circ)]\times[1/(F\times 360^\circ)]. \quad (11)$$

Thus, the total time difference between $t_1$ and $t_2$ can be calculated as:

$$\Delta T=[(5-Q1)\times 90^\circ+(\Phi 1-45^\circ)+(Q2\times 90^\circ)-(\Phi 2+45^\circ)+(N\times 360^\circ)]\times[1/(F\times 360^\circ)] \quad (12)$$

for the case where both $t_1$ and $t_2$ lie in either quadrant 1 or quadrant 2. The computer 380 employs Equation (12) when the two-bit quadrant value contained within the memory location corresponding to $t_1$ is 1 or 2, and the two-bit quadrant value contained within the memory location corresponding to $t_2$ is 1 or 2.

An example which illustrates how the time difference between detected events is calculated using the formulas shown above follows. Assume that it is desired to calculate the time difference between two events as shown in FIG. 7A. The first event, $t_1$, is shown in FIG. 7A to occur in the fourth quadrant of the effective reference signal 150, thus $Q1=4$. At the time $t_1$, the voltage of the effective reference signal 150 is approximately $-0.5$ volts. Since the voltage levels are sampled in increments of 0.0078125 volts, the nearest sampled value is calculated as $-64\times 0.0078125$ volts, or $-0.5$ volts. A voltage of $-0.5$ volts corresponds to an angle value of $-30.0^\circ$ within the arcsine table PROM 355, thus $\Phi 1=-30.0^\circ$.

The second event, $t_2$, is shown to occur in the fourth quadrant of the effective reference signal 150, thus $Q2=4$. At the time $t_2$, the voltage of the effective reference signal 150 is approximately $-0.15$ volts. Since the voltage levels are sampled in increments of 0.0078125 volts, the nearest sampled value is calculated as $-19\times 0.0078125$ volts, or $-0.148$ volts. Note that there is an error of 0.002 volts introduced here due to the digital sampling increment. A voltage level of $-0.148$ volts corresponds to an angle value of $-8.5^\circ$ within the arcsine table PROM 355, thus $\Phi 2=-8.5^\circ$. If the sampling error had not been introduced, the actual angle value would be 8.6° indicating an angular error of 0.1°.

Finally, the number of full cycles elapsed between $t_1$ and $t_2$ is six, therefore $N=6$, and the frequency of the effective reference signal 150 is arbitrarily chosen to be 50 MHz. According to the formula of Equation (6):

$$\Delta T=[(5-4)\times 90^\circ+(-30^\circ+45^\circ)+(4\times 90^\circ)+(-8.5^\circ-45)+(6\times 360^\circ)]\times[1/(50\ MHz\times 360^\circ)].$$

Which reduces to:

$$\Delta T=[2540.5^\circ]\times[1/(50\ MHz\times 360^\circ)],$$

or, $$\Delta T=141.14 \text{ nanoseconds}$$

In this particular example, the error due to the sampling increment is less than 6 picoseconds (0.1°/(50 MHz×360°)), however, the error due to the aperture jitter of the analog to digital convertors 320, 325 is generally greater than this and thus becomes the dominant source of error.

In this manner the time difference between electrical events can be determined to a very high accuracy. As stated above, the resolution of the time measurement system 200 is dependent upon the frequency of the effective reference signal 150, and the sampling rate of the analog-to-digital convertors 320, 325. Theoretically, the resolution of the time measurement system could be increased indefinitely as the frequency of the effective reference signal 150 is increased, as long as a pure sine and cosine wave could be generated at such high frequencies. Practically, however, a limiting factor is introduced within the analog-to-digital convertors 320, 325.

Recall that each analog-to-digital convertor 320, 325, has an associated conversion delay time of $Y+\sigma$, where Y is a constant conversion time, and $\sigma$ is a variable aperture jitter which varies randomly each time the analog-to-digital convertor 320, 325 is clocked by an initiating pulse which represents an event. When the sine and cosine waves are converted into digital signals, the analog-to-digital convertor 320 outputs a digital value corresponding to the amplitude of the sine wave input, $y_1(t)$, at a time $Y_1+\sigma_1$ after the initiating clock pulse, while the analog-to-digital convertor 325 outputs a digital value corresponding to the amplitude of the cosine wave input, $y_2(t)$, at a time $Y_2+\sigma_2$ after the initiating clock pulse. Thus there exists a time differential, $\delta t$, between the digital conversion of $y_1(t)$ and $y_2(t)$ which can be calculated as:

$$\delta t=(Y_1+\sigma_1)-(Y_2+\sigma_2) \quad (22)$$

or alternatively as:

$$\delta t=(Y_1-Y_2)+(\sigma_1-\sigma_2). \quad (23)$$

The difference $Y_1-Y_2$ is a constant difference and can be calibrated out of the system. However, the difference $\sigma_1-\sigma_2$ varies with each conversion, and thereby produces an unknown time deviation for each time measurement. The deviation $\sigma_1-\sigma_2$ is typically on the order of 10 picoseconds, so that the associated uncertainty of the output of the time measurement system 200 is 10 picoseconds. This uncertainty is separate from the uncertainty related to the sampling increment employed in the time measurement system 200. In practical applications however, the uncertainty related to the sampling increment of the time measurement system can be reduced by increasing the frequency of the effective reference signal 150, until the uncertainty associated with the deviation $\sigma_1 - \sigma_2$ becomes the dominant factor.

Of course, as advancements are made in technology, the aperture jitter of the analog-to-digital convertors 320, 325 is expected to decrease, thereby providing a higher resolution to the time measurement system 200.

While the above description contains many specificities, the reader should not construe these as limitations on the scope of the present invention, but merely as preferred embodiments thereof. Those skilled in the art will envision other possible variations within the scope of the present invention.

We claim:

1. An apparatus for measuring the time elapsed between events comprising:

a sinusoidal wave generator that produces first and second sinusoidal waves which are 90° out of phase with respect to one another;

sampling circuit that samples instantaneous amplitudes of said sinusoidal waves in response to each event and that outputs first and second digital values which correspond to said instantaneous amplitudes when each event occurs;

a magnitude comparator that measures the magnitude of at least one of said first and second digital values and that outputs a signal indicating which of said first and second sinusoidal waves is currently in an angular quadrant having the greatest average change in magnitude per change in angular position;

a multiplexer that receives said first and second digital values and that receives said indicating signal from said magnitude comparator, said multiplexer providing an output digital value corresponding to the digital value of the sinusoidal wave currently in an angular quadrant having the greatest average change in magnitude per change in angular position when each event occurs;

a quadrant detector that receives said first and second digital values and that outputs a quadrant identifier signal that identifies which of four angular quadrants said first and second sinusoidal signals are in when each event occurs:

a convertor that receives said output digital value from said multiplexer and that outputs a digital angular position value that identifies a unique angular position within one angular quadrant of said first and second sinusoidal signals for each event in response to said sampled values;

a data storage device that receives said digital angular position value from said converter and said quadrant identifier signal from said quadrant detector and that stores said angular position value and said quadrant identifier signal for each event;

a cycle counter that counts the number of full cycles between each event; and processing circuitry that determines the total time elapsed between said events in response to said stored angular position values and said stored quadrant identifier signals for each of said events and in response to the output of said cycle counter.

2. An apparatus as defined in claim 1 wherein said processing circuitry is a microprocessor.

3. An apparatus as defined in claim 1 wherein said processing circuitry is a computer.

4. An apparatus as defined in claim 1 wherein said sampling circuitry is an analog-to-digital convertor.

5. An apparatus for measuring the time elapsed between electrical events comprising:

a sinusoidal wave generator which outputs a first sinusoidal signal and a second sinusoidal signal, said second sinusoidal signal having instantaneous amplitudes 90° out of phase with instantaneous amplitudes of said first sinusoidal signal, said sinusoidal signals having respective maximum positive and negative amplitudes;

an amplitude sampler which outputs a first value corresponding to the instantaneous amplitude of said first sinusoidal signal and a second value corresponding to the instantaneous amplitude of said second sinusoidal signal in response to an electrical event;

a comparator that receives at least one of said first and second values and that outputs a selection signal that indicates which of said first and second values corresponds to an instantaneous amplitude between 0.707 of its maximum negative amplitude and 0.707 of its maximum positive amplitude;

a multiplexer which alternatively selects one of said first and second values in response to said selection signal and provides said one value as an output;

a quadrant detector that receives said first and second values and that generates a quadrant indication signal that identifies which of four quadrants of said first and second sinusoidal signals said selected value is in when said electrical event occurs;

a convertor which outputs an angular positional value in response to the selected one of said first and second values, said positional value corresponding to the time at which said electrical event occurred;

a device that stores said angular position value and said quadrant identifier signal in association with said electrical event;

a cycle counter which accounts for each full cycle of said effective reference signal after the occurrence of said electrical event; and processing circuitry which computes the time elapsed between two of said electrical events based upon the stored angular positional value and quadrant identifier signal corresponding to each one of said two electrical events and the number of full cycles elapsing between said two electrical events.

6. The apparatus as defined in claim 5 wherein said amplitude sampler outputs a first digital value and a second digital value.

7. The apparatus as defined in claim 5 wherein said processing circuitry is a computer.

8. A method for measuring the time elapsed between first and second electrical events comprising the steps of:

outputting a first sinusoidal signal and a second sinusoidal signal, said second sinusoidal signal being 90° out of phase with said first sinusoidal signal;

sampling the instantaneous amplitude of said first and second sinusoidal signals and outputting a first value corresponding to said instantaneous amplitude of said first sinusoidal signal, and a second value corresponding to said instantaneous amplitude of said second sinusoidal signal in response to said first electrical event;

outputting a select signal that indicates which of said first and second values corresponds to an instantaneous amplitude having a magnitude less than the instantaneous amplitude of the other of said first and second values;

selecting one of said first and second values in response to said select signal so that said selected value falls within the quadrant of said sinusoidal signal which provides the greatest average measurement resolution;

outputting a first angular positional value in response to the selected one of said first and second values, said first angular positional value corresponding to the time at which said first electrical event occurred;

identifying one of four quadrants in which said first and second sinusoidal signals are in when each event occurs;

accounting for each full cycle of said first and second sinusoidal signals after the occurrence of said first electrical event until the occurrence of said second electrical event;

repeating said steps of sampling, comparing, selecting, outputting an angular positional value and identifying in response to said second electrical event; and computing the time elapsed between said first and second electrical events based upon said first and second angular positional values and said identified quadrants for each of said electrical events, and the number of full cycles elapsing between said first and second electrical events.

9. An apparatus as defined in claim 1, wherein said convertor comprises an arcsine table memory.

10. An apparatus as defined in claim 1, wherein said first and second sinusoidal waves are digitized and applied to said multiplexer.

11. A method for measuring the time elapsed between electrical events comprising the steps of:

generating first and second sinusoidal signals, said second sinusoidal signal having instantaneous amplitudes 90° out of phase with instantaneous amplitudes of said first sinusoidal signal, said sinusoidal signals having substantially equal maximum positive and negative amplitudes;

sampling said first and second sinusoidal signals and outputting a first value corresponding to the instantaneous amplitude of said first sinusoidal signal and a second value corresponding to the instantaneous amplitude of said second sinusoidal signal in response to an electrical event;

outputting a selection signal that indicates which of said first and second values corresponds to an instantaneous amplitude between 0.707 of its maximum negative amplitude and 0.707 of its maximum positive amplitude;

selecting one of said first and second values in response to said selection signal and providing said one value as an output;

generating a quadrant indication signal that identifies which of four quadrants of said first and second sinusoidal signals said selected value is in when said electrical event occurs;

outputting an angular position value in response to the selected one of said first and second values, said angular position value corresponding to the time at which said electrical event occurred;

storing said angular position value and said quadrant identifier signal in association with said electrical event;

counting each full cycle of one of said first and second sinusoidal signals after the occurrence of said electrical event; and computing the time elapsed between two of said electrical events based upon the stored angular positional value and quadrant identifier signal corresponding to each one of said two electrical events and the number of full cycles elapsing between said two electrical events.

12. A method of measuring the time between electrical events, comprising the steps of:

providing first and second sinusoidal signals each having continually varying instantaneous amplitudes, one of said signals being delayed in phase by 90° with respect to the other signal;

sampling said first and second sinusoidal signals on occurrence of each electrical event and providing respective first and second digital output signals having values corresponding to the respective instantaneous amplitudes of said first and second sinusoidal signals;

selecting one of said first and second digital output signals having an absolute value less than the absolute value of the other of said digital output signals such that said selected digital signal has a greater magnitude resolution per unit time than the other digital signal;

detecting which of four quadrants said selected digital signal is in and providing a quadrant indication signal;

converting said digital signal to a time value corresponding to a location in time of said electrical event with respect to the beginning of a quadrant of one of said first and second sinusoidal signals;

storing said quadrant indication signal and said time value signal on occurrence of each electrical signal to uniquely identify a time of occurrence of each electrical signal within a cycle of one of said first and second sinusoidal signals;

counting a number of full cycles of one of said first and second sinusoidal signals between the occurrence of two of said electrical signals; and computing an amount of time between said two of said electrical signals by adding an amount of time corresponding to said number of full cycles and amounts of time determined by said stored times of occurrence of said electrical signals.

* * * * *